United States Patent [19]

Behrens

[11] Patent Number: 4,689,893

[45] Date of Patent: Sep. 1, 1987

[54] APPARATUS AND METHOD FOR DRYING ELONGATED WEBS

[75] Inventor: Rudolph Behrens, Collegeville, Pa.

[73] Assignee: BCD Dryers, Inc., Totowa, N.J.

[21] Appl. No.: 893,225

[22] Filed: Aug. 5, 1986

[51] Int. Cl.[4] ..... F26B 13/02; F26B 3/04

[52] U.S. Cl. ..... 34/23; 34/155; 34/160

[58] Field of Search ..... 68/5 R, 5 A, 5 B, 5 C, 68/5 D; 34/155, 156, 160, 23

[56] References Cited

U.S. PATENT DOCUMENTS

| | | | |
|---|---|---|---|
| 2,574,844 | 11/1951 | Roden | 34/160 |
| 3,109,721 | 11/1963 | Zenner et al. . | |
| 3,465,500 | 9/1969 | Fenn . | |
| 3,495,932 | 2/1970 | Tuma | 34/160 |
| 3,616,596 | 11/1971 | Campargue . | |
| 3,626,665 | 12/1971 | Fenn et al. . | |
| 3,788,038 | 1/1974 | Zahner . | |
| 4,116,620 | 9/1978 | Stibbe . | |
| 4,125,948 | 11/1978 | Hering, Jr. et al. . | |
| 4,136,636 | 1/1979 | Ellison et al. . | |

*Primary Examiner*—Larry I. Schwartz

*Attorney, Agent, or Firm*—Robert S. Stoll

[57] ABSTRACT

Apparatus and method for drying fresh printed web material such as vinyl by reduction in ambient air pressure surrounding the web by forming the web into an air foil and passing warm dry air thereover.

18 Claims, 5 Drawing Figures

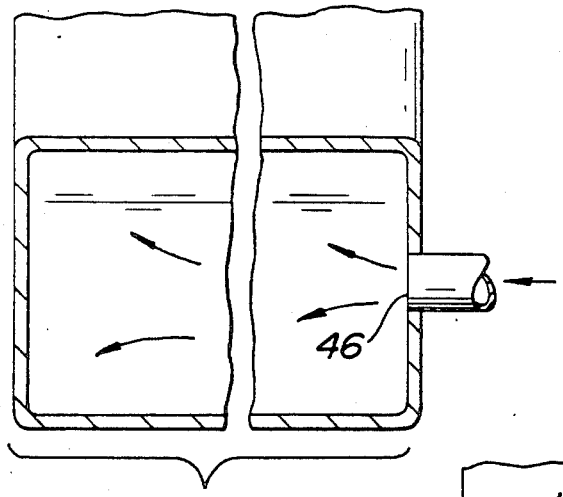
FIG. 2
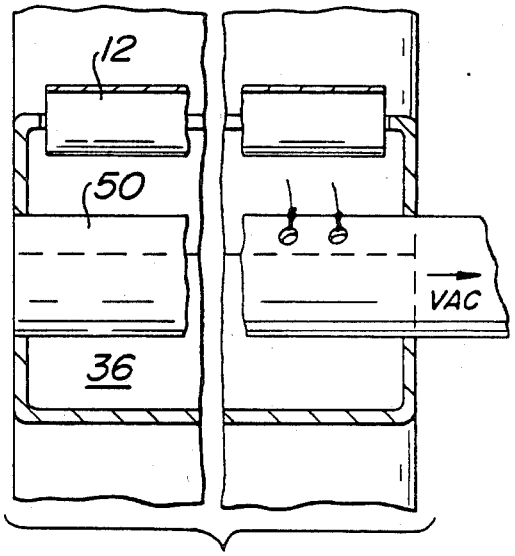
FIG. 3
FIG. 4
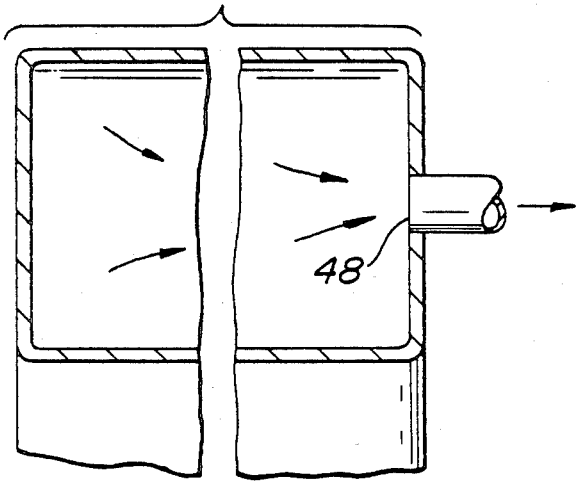

APPARATUS AND METHOD FOR DRYING ELONGATED WEBS

BACKGROUND OF THE INVENTION

This invention relates to apparatus and a method for drying elongated webs, especially freshly printed webs. More particulaly, this invention relates to apparatus and a method which are useful for the drying of webs of polymeric material, such as vinyl, to which chemical or water-based inks have been applied.

In general, in conventional apparatus and methods the drying of webs is accomplished by a mechanical removal and evaporation of residual liquids. As is well known, liquids can be made to evaporate by causing their vapor pressure to exceed ambient pressure. This is most readily achieved by raising the temperature of the liquid sought to be evaporated, and explains why conventional drying apparatus, such as the apparatus disclosed in U.S. Pat. No. 4,125,948, issued Nov. 21, 1978, to Henry H. Hering, Jr. et al, suggests the technique of blowing heated air onto the web to be dried. But the use of impinging hot air in the conventional manner dictates certain compromises, the most serious of which being that the temperature of the air must be carefully monitored and controlled if damage to the web is to be avoided. Drying by the impingement of hot air is further complicated by the unavoidable existence of a dense boundary layer of air at the surface of the web. The boundary layer of air at the surface of the web. The boundary layer, being typically approximately 1.1 to 1.3 time as dense as the surrounding air, is heat absorbtive, and moreover, heavily charged with staic electricity, which makes it highly cohesive. Both its density and its cohesiveness make the boundary layer an effective insulator of the web and a barrier to the introduction of heat for evaporation. Thus, conventional drying apparatus and methods, using impingement, are crude in terms of their application of physical principles, and wasteful of energy.

SUMMARY OF THE INVENTION

In accordance with the present invention, rather than attempt to reduce the vapor pressure of the material to be evaporated by heating that material, the desired end result, evaporation, is achieved by a reduction of the pressure of the ambient air. By reducing ambient air pressure, the vapor pressure of the liquid to be evaporated can be made to exceed ambient pressure without any increase in temperature. Indeed, if it were posible to reduce the ambient air pressure over a web and keep the air dry so as to maintain its capacity to absorb additional liquid, it would be possible to completely dry a web, using water-base ink, within the 54 inch running length available between the print stations of existing multiple printers at speeds comparable to those achieved by in-line printers.

In accordance with the present invention, the desired reduction in ambient air pressure is accomplished by forming the web to be dried into an airfoil shape, and passing warm dry air over its surface so that the pressure over the surface of the web is reduced by Bernoulli's Principle. By careful selection of the airfoil section in accordance with the principles of this invention, controlled separation of the boundary layer can be achieved, thus avoiding the disadvantageous effect of the laminar boundary layer characteristic of the prior art.

The present invention also contemplates the continous removal of large quantities of moisture from the drying air in an energy-efficient and advantageous manner. In this regard, a shock wave is created adjacent the drying zone defined by the above mentioned airfoil section, and the shock wave creates a vapor-rich area from which the evaporated material may readily be removed.

The above described techniques may be applied in a presently preferred form of the apparatus (which constitutes the best mode presently contemplated for carrying the invention into effect) which comprises a hollow housing through which the web may pass, and into which a stream of warm dry air may be introduced and exhausted. Within the housing there is an airfoil shaped surface over whcih the web passes, forming the web, in effect, into an airfoil shape. The above mentioned air stream passes over the surface of the web, thus creating within the housing a region of reduced pressure to which the web is exposed. By regulating the air stream in accordance with know aero- and thermodynamic principles, a shock wave can be induced, thus causing the evaporated material to concentrate and condense in a predetermined zone. The thus gathered material can be drawn off, and the dried air recycled if so desired. In a presently contemplated embodiment, the evaporated material is drawn off by a vacuum roller, that is a rotating drum with a perforated surface, the interior of which is coupled to a vacuum source.

THE DRAWINGS

There is seen in the drawings a form of the invention which is presently preferred, it being understood that the invention is not limited to the precise arrangements and instrumentalities shown.

FIG. 2 is a cross-selectional view through the applicant's dryer apparatus, taken along the line 2—2 in FIG. 1.

FIG. 3 is a cross-sectional view taken along the line 3—3 in FIG. 1.

FIG. 4 is a cross-sectional view taken along the line 4—4 in FIG. 1.

Figure 1:
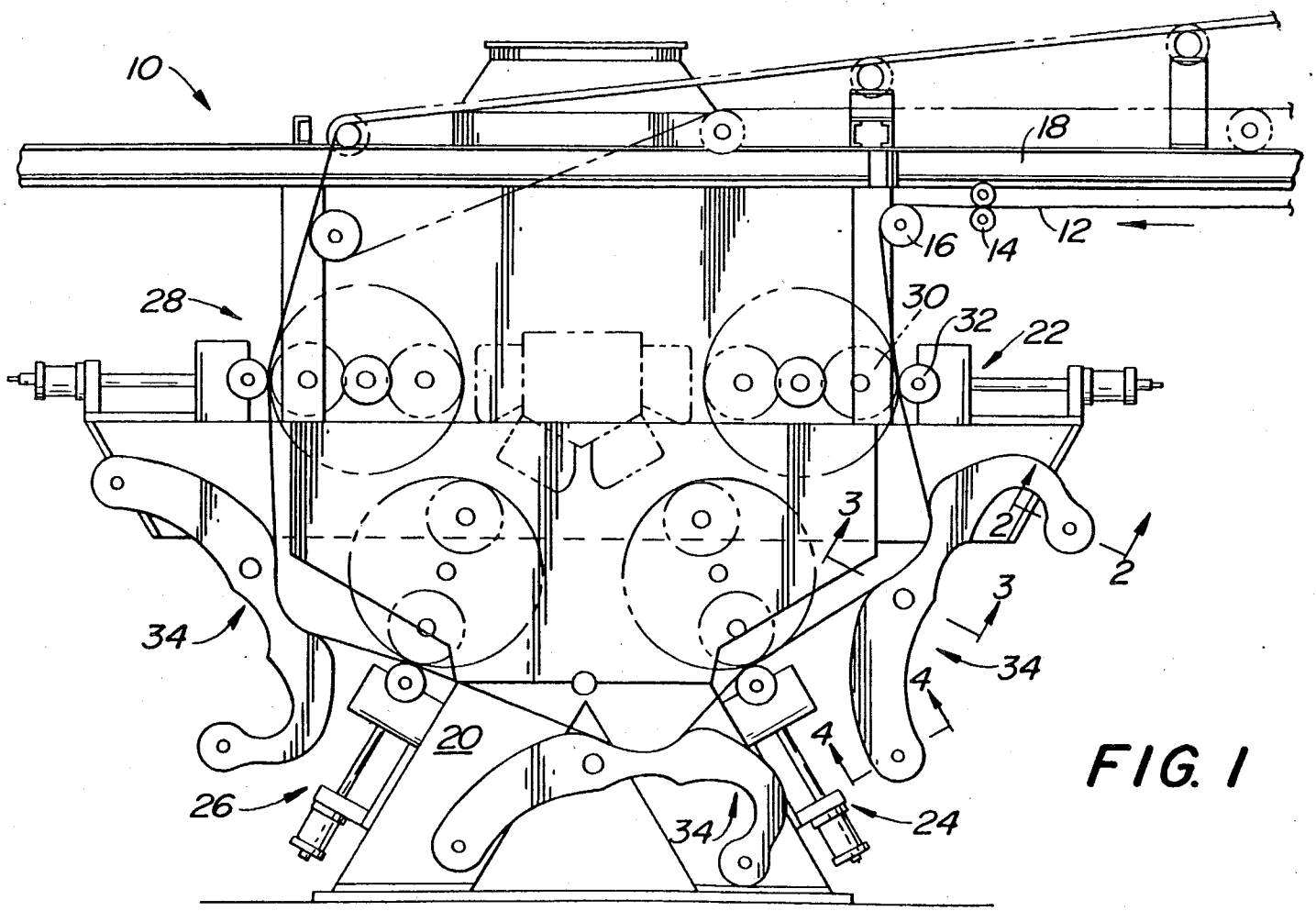
FIG. 1 is a side elevation view of a portion of a multistage continuous web printer, the applicant's dryer apparatus being associated therewith.

Referring now to the drawings in detail, wherein like numerals indicate like elements, there is seen in FIG. 1 apparatus designated generally by the reference numeral 10 for printing and drying a continuous web or substrate. With reference to the Figure, the web or substrate 12, taken from a supply roll (not shown) is supported and guided by suitable rollers 14, 16, assoicated with the frame 18 of the apparatus 10. Also associated with the frame 18 is a support subframe 20, which supports, in the illustrated form of the apparatus, four printing stations designated generally by reference numerals 22–28 , disposed in a generally U-shape configuration along the path of travel of the web 12. Each of the printing stations 22–28 is provided with print and backing rollers 30 and 32, the web 12 passing between such rollers.

It will be understood that each of the printing stations 22–28 , in conventional operation, will apply to the web 12 a one-component of an overall four-component design. Thus, as a given segment of the web 12 passes through one of the printing stations 22–28, the web carries away with it ink deposited on the web at that printing station. More or fewer stations could be used if desired. The ink may be either chemical or water-base, and until drying of the web, the printed matter is subject to blurring, smearing or distortion.

Disposed between adjacent printing stations 22–28 is dryer apparatus designated generally by the refernce numeral 34.

Figure 5:
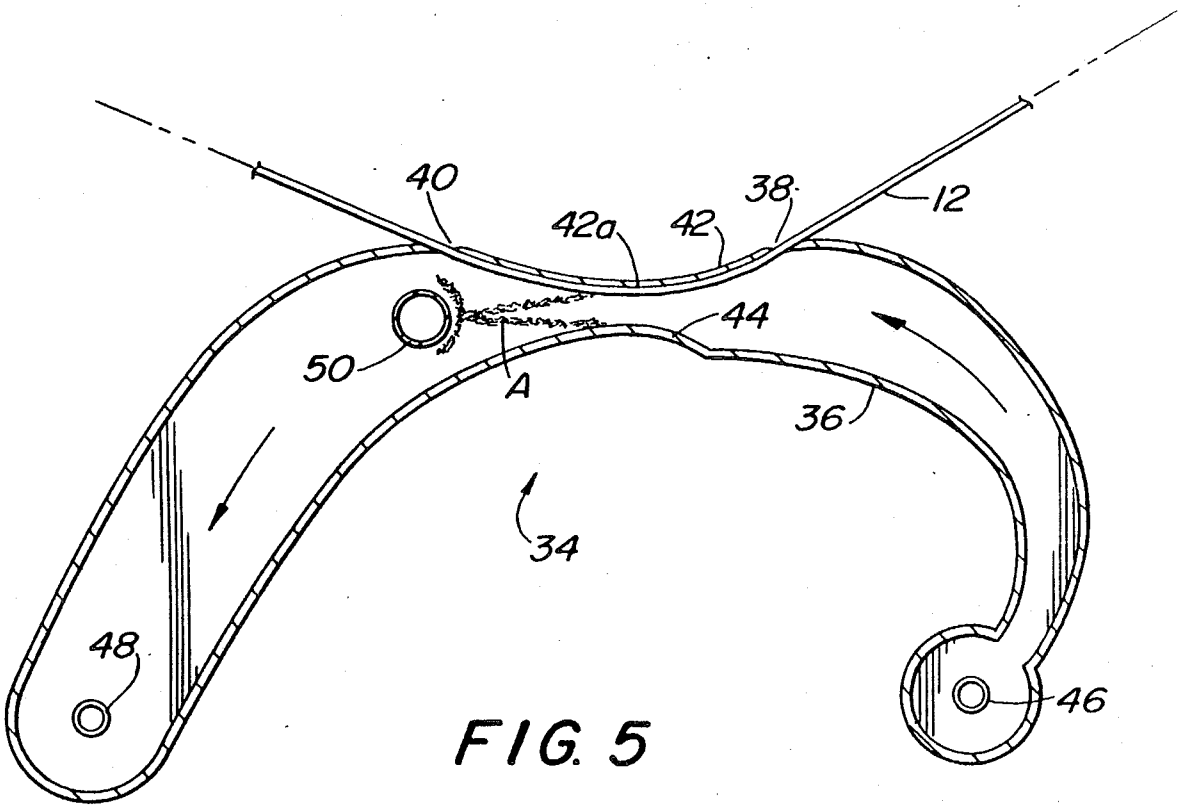
FIG. 5 is a longitudinal cross-sectional view of apparatus in accordance with the invention.

Referring now to FIG. 5, dryer apparatus 34 is seen in greater detail. The dryer apparatus 34 comprises a hollow housing 36 having a slot 38 therein providing a web inlet and a slot 40 therein providing a web outlet. Disposed between the slots 38 and 40 is an airfoil-shaped wall 42, which also serves as a guide-means and support for a web 12 passing through the housing 36. In the preferred form of the invention, the wall 42 and its airfoil section are complemented by and opposed secondary airfoil section, defined by an opposed wall 44 of the housing 36.

Upstream of the above described walls 42 and 44 is an inlet 46 (seen also in FIG. 2) for a stream of drying gas, such as filtered ambient air. Downstream of the walls 42 and 44 is an outlet 48 (also seen in FIG. 4) for the drying gas. Drying gas exiting from the housing 36 may be filtered, heated if desired, and then recycled to the inlet 46 for reuse.

The airfoil sections defined by the walls 42 and 44 are preferably of types which provide early controlled separation of the boundary layer, thus facilitating turbulent flow, and hence, heat transfer and material transport from the surface of the web 12 downstream of the separation point 42*a* of the airfoil.

By judicious selction of the volume of flow within the housing 36, the separating boundary layer from the airfoil 42*a* and web 12 can be made to collide with the boundary layer separating from the opposed secondary airfoil so as to cause a shock wave, with a characteristic area of reduce presure behind it. By selection of the size and position of the airfoils, the shock wave may be positioned where desired, to best accomplish the purposes of the invention. For example, in the illistrated form of the invention, the airfoil defined by the wall 44 is approximately 8/10 the size of the airfoil defined by the wall 42, a figure chosen arbitrarily so as to position the shock wave (designated in the drawing by the letter "A") nearer the lower wall 44 of the housing 36.

Aspects of the operation of the dryer apparatus and of the method should now be apparent. The opposed airfoils create within the housing 36 and in proximity to the web 12 a region of reduced pressure, the reduction of pressure serving by well-known physical principles to induce evaporation of moisture from the web 12. Moisture thus removed from the web 12, having physical characteristics different from the drying gas, is separated from the drying gas by the shock wave A, and migrates to the region of reduced pressure behind and adjacent to the shock wave.

Referring now to FIG. 3, there is seen apparatus for removing evaporated liquid after its separation from drying gas. For this purpose, a perforated drum 50 is rotatably mounted within the housing 36 downstream of the airfoil sections in the vicinity of the anticipated locality of the above-described shock wave. A source of vacuum, not shown, is applied to the interior of the drum 50, and causes condensate in the vicinity of the drum 50 to be removed from the housing 36 through the perforations of the drum. The condensate thus removed may be discarded if so desired, or if environmental or economic factors so dictate, collected for reclamation and reuse.

Those skilled in the art will recognize and appreciate the desirability of having in the housing 36 a smooth flow if drying gas, ideally without turbulence except where turbulence is induced for the purposes of the invention. A suitable shape may be arrived at by various design techniques which occur to those skilled in the art. In one proposed form of the invention. Bernoulli's theorem and the upper and lower speeds of the anticipated gas flow were processed in an IBM 370 computer to generate a conic surface representing all conditions within the housing 36. By slicing off segments of that cone (determined by how it was desired to bend and direct the airflow) and then "unwinding" the cone, a side profile approximating that shown in FIG. 5 was generated.

The present invention may be embodied in other specific forms without departing form its spirit or essential attributes, and, accordingly, reference should be made to the appended claims rather than the foregoing specification and accompanying drawings as indicating the scope of the invnetion.

In the term "NACA-64A414" as used in the claims, "NACA" stands for National Air Commerce Administration, a Federal agency which was a precursor to NASA (National Air and Space Administration), "64" denotes that the center of lift ($C_{li}$) is 60/4, "A" denotes a slotted design, "4" denotes the camber line is 4/10ths of a chord and "14" denotes that the thickness of the thickest part is 14% of a chord.

I claim:

1. For use in association with apparatus for printing an elongated web, web dryer apparatus comprising a hollow housing having a web inlet and a web outlet therein, guide means in said housing for conducting at least a portion of said web within said housing from said inlet to said outlet, means for admitting a gas stream to said housing and means permitting said gas stream to exit therefrom, airfoil means within said housing and disposed between said inlet and said outlet for creating in said housing a region of reduced pressure in the vicinity of the web to induce evaporation from the web, said airfoil means comprising a passage having a wall defining an airfoil section, said portion of said web being in the flow of said gas stream as it passes over said airfoil section, and means in fluid communication with said housing for removing evaporated liquid from said housing.

2. Apparatus in accordance with claim 1, wherein at least said portion of said web is in sufficient proximity to said wall so as to approximate the airfoil section thereof.

3. Apparatus in accordance with claim 1 or 2, wherein said guide means comprises said wall, said airfoil section being disposed between said web inlet and said web outlet.

4. Apparatus in accordance with claim 3, and means for inducing in said housing down-stream of said region of reduced pressure a standing shock wave, said means for removing evaporated liquid from said housing being in proximity to the shock wave.

5. Apparatus in accordance with claim 4, wherein means for removing condensate comprises an opening and vacuum means associated with said opening.

6. Apparatus in accordance with claim 4, wherein said means for inducing a shock wave comprises a second wall defining an airfoil section, said airfoil section of said second wall being disposed in opposition and inverted relation with respect to the airfoil section of said first wall.

7. Apparatus in accordance with claim 3, wherein means for removing condensate comprises a rotating drum having a perforated surface and vacuum means associated with the interior of said drum.

8. Apparatus in accordance with claim 6, wherein said chamber is so configured and arranged as to provide substantially laminar flow therein upstream of said airfoil sections.

9. Apparatus in accordance with claim 7, wherein said airfoil sections are charactierized by having early controlled separation of their boundary layers.

10. Apparatus in accordance with claim 8, wherein said airfoil sections are NACA-64A414.

11. Apparatus in accordance with claim 6, wherein one of said airfoil sections differs in size from the other, whereby the shock wave induced by said airfoil sections is disposed closer to one wall than the other.

12. Apparatus in accordance with claim 11, wherein means for removing condensate comprises an opening and vacuum means associated with said opening.

13. Apparatus in accordance with claim 12, wherein said airfoil sections are characterized by having early controlled separation of their boundary layers.

14. Apparatus in accordance with claim 13, wherein said airfoil sections are NACA-64A414.

15. A method of drying an elongated web having freshly printed matter theron, comprising the steps of introducing the web into a drying zone and continously advancing the web therethrough, creating in the drying zone and in proximity to the web a region of reduced pressure by accelerating a gaseous drying medium through a passageway of restricted cross-section, defined at least in part by an airfoil, the web being advanced through said passageway whereby evaporation of liquid associated with the web is enhanced, removing the evaporated liquid from the drying zone and removing the web from the drying zone.

16. A method in accordance with claim 15, wherein the step of removing the evaporated liquid is performed by inducing in proximity to said drying zone a shock wave to separate evaporated liquid from the atmosphere in the drying zone, and collecting and removing the separated liquid from the atmosphere.

17. A method in accordance with claim 16, wherein the shock wave is so induced as to be disposed downstream of the restricted cross-section of the passageway.

18. A method in accordance with claim 17, wherein said step of collecting and removing the separated liquid from the atmosphere is performed by the application of vacuum.

* * * * *